US008368760B1

(12) United States Patent
Bates

(10) Patent No.: US 8,368,760 B1
(45) Date of Patent: Feb. 5, 2013

(54) SYSTEM AND METHOD TO GENERATE AND DISPLAY TARGET PATTERNS

(75) Inventor: Kenn S. Bates, Lakewood, CA (US)

(73) Assignee: Raytheon Company, Waltham, MA (US)

( * ) Notice: Subject to any disclaimer, the term of this patent is extended or adjusted under 35 U.S.C. 154(b) by 664 days.

(21) Appl. No.: 12/580,920

(22) Filed: Oct. 16, 2009

Related U.S. Application Data

(60) Provisional application No. 61/105,933, filed on Oct. 16, 2008.

(51) Int. Cl.
*G09G 3/34* (2006.01)

(52) U.S. Cl. ..... 348/164; 345/107; 359/290; 359/291; 359/296

(58) Field of Classification Search ..... 348/164; 345/107; 340/572.1; 359/290–297
See application file for complete search history.

(56) References Cited

U.S. PATENT DOCUMENTS

| | | | | |
|---|---|---|---|---|
| 4,387,301 | A | 6/1983 | Wirick et al. | |
| 4,480,372 | A | 11/1984 | Wirick et al. | |
| 4,929,841 | A | 5/1990 | Chang | |
| 5,041,735 | A | 8/1991 | Chang et al. | |
| 5,254,981 | A * | 10/1993 | Disanto et al. | 345/107 |
| 5,324,937 | A | 6/1994 | Chen et al. | |
| 5,416,332 | A | 5/1995 | Chen et al. | |
| 5,561,443 | A * | 10/1996 | Disanto et al. | 359/296 |
| 5,691,542 | A | 11/1997 | Bates et al. | |
| 7,675,672 | B2 * | 3/2010 | Cernasov | 359/296 |
| 7,843,623 | B2 * | 11/2010 | Cernasov | 359/296 |
| 8,274,472 | B1 * | 9/2012 | Wang et al. | 345/107 |
| 2002/0024715 | A1 * | 2/2002 | Garner et al. | 359/290 |
| 2002/0033792 | A1 * | 3/2002 | Inoue | 345/107 |
| 2010/0052909 | A1 * | 3/2010 | Doan et al. | 340/572.1 |

OTHER PUBLICATIONS

"*E Ink Drives Electronic Paper Market Forward; New Vizplex Imaging Film Is Brighter and Faster*", E Ink Press Release, http:/www.eink.com/press/releases/pr100.html, 2 pages, May 9, 2007.
"*E Ink Introduces Next Generation of Custom Segmented Displays Using E Ink Vizplex Imaging Film*", E Ink Press Release, http:/www.eink.com/press/releases/pr102.html, 2 pages, May 23, 2007.
"*Epson and E Ink Announce Breakthrough Controller IC for Electronic Paper Displays*", E Ink Press Release, http:/www.eink.com/press/releases/pr110.html, 3 pages, Apr. 15, 2008.

* cited by examiner

*Primary Examiner* — Bharat N Barot
(74) *Attorney, Agent, or Firm* — Renner, Otto, Boisselle & Sklar, LLP

(57) ABSTRACT

According to one embodiment, a target system includes a display module comprising a plurality of pixel elements operable to display target patterns. Each pixel element includes a display segment, a plurality of first charged pigments housed within the display segment each having a first charge, a plurality of second charged pigments housed within the display segment each having a second charge, wherein the first charge is opposite the second charge, and an electrical contact coupled to the display segment and operable to receive signals which cause an electric field to be present in the display segment. The system also includes at least one computer-readable tangible storage medium comprising executable code that, when executed by at least one processor, is operable to transmit signals to the display module that cause an electric field to be present in at least one pixel element of the plurality of pixel elements. In addition, the system includes a heating element coupled to the display module and operable to emit an infrared pattern that is modified by the plurality of pixel elements.

21 Claims, 4 Drawing Sheets

SYSTEM AND METHOD TO GENERATE AND DISPLAY TARGET PATTERNS

RELATED APPLICATION

This application claims benefit under 35 U.S.C. §119(e) of U.S. Provisional Application Ser. No. 61/105,933, entitled "System And Method For Dynamic Infrared Targeting,", filed Oct. 16, 2008, by Kenn S. Bates, which is incorporated herein by reference.

TECHNICAL FIELD

This invention relates generally to targets and more particularly to a system and method for target generation.

BACKGROUND

Target systems, such as infrared (IR) target systems, are useful for testing various types of equipment, such as weapons. However, static target systems provide only limited functionality for useful testing of some existing systems as well as newly developed technology. For example, a static target system does not allow for the target to change dynamically during testing. Further, target systems have suffered from being inflexible in that the target patterns are not programmable and cannot be easily modified.

Certain solutions to these issues have been unsatisfactory. For example, some target systems utilize mechanical means to provide for dynamic rather than static targets. Yet, these are custom, cumbersome, and can be expensive. Other examples include a resistor emitter array, which provides the ability to have a programmable target, but these are very expensive.

SUMMARY

According to one embodiment, a target system includes a display module comprising a plurality of pixel elements operable to display target patterns. Each pixel element includes a display segment, a plurality of first charged pigments housed within the display segment each having a first charge, a plurality of second charged pigments housed within the display segment each having a second charge, wherein the first charge is opposite the second charge, and an electrical contact coupled to the display segment and operable to receive signals which cause an electric field to be present in the display segment. The system also includes at least one computer-readable tangible storage medium comprising executable code that, when executed by at least one processor, is operable to transmit signals to the display module that cause an electric field to be present in at least one pixel element of the plurality of pixel elements. In addition, the system includes a heating element coupled to the display module and operable to emit an infrared pattern that is modified by the plurality of pixel elements.

In some embodiments, the at least one computer-readable tangible storage medium may include stored target patterns. The executable code, when executed by the at least one processor, may further operable to transmit a set of signals corresponding to a dynamic target pattern. The target system may also include a window coupled to the display module and operable to facilitate thermal transmission.

According to another embodiment, a target system includes a display module comprising a plurality of pixel elements operable to display target patterns. Each pixel element includes a display segment, a plurality of first charged pigments housed within the display segment each having a first charge, a plurality of second charged pigments housed within the display segment each having a second charge, wherein the first charge is opposite the second charge, and an electrical contact coupled to the display segment and operable to receive signals which cause an electric field to be present in the display segment. The system also includes at least one computer-readable tangible storage medium comprising executable code that, when executed by at least one processor, is operable to transmit signals to the display module that cause an electric field to be present in at least one pixel element of the plurality of pixel elements. In addition, the system includes an optics module coupled to the display module and operable to project a focal plane associated with the display module.

Depending on the specific features implemented, particular embodiments may exhibit some, none, or all of the following technical advantages. An inexpensive programmable targeting system may be realized. Further, an inexpensive dynamic or moving target system may be produced. Other technical advantages will be readily apparent to one skilled in the art from the following figures, description, and claims.

BRIEF DESCRIPTION OF THE DRAWINGS

Reference is now made to the following description taken in conjunction with the accompanying drawings, wherein like reference numbers represent like parts and which.

DETAILED DESCRIPTION

Figure 1A:
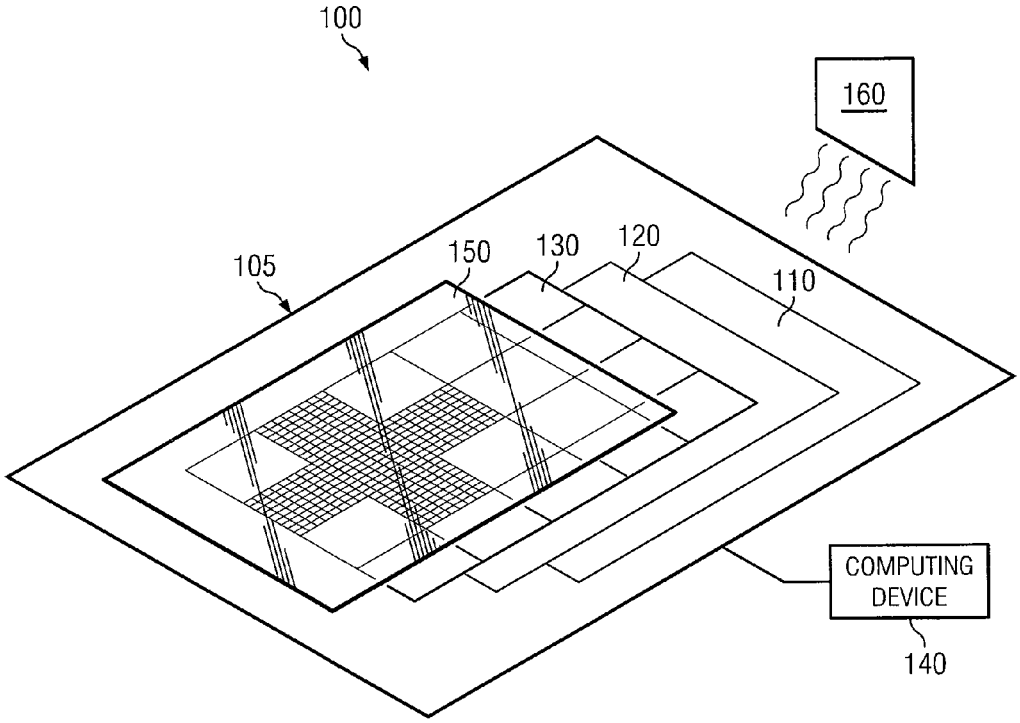
FIG. 1A illustrates one embodiment of a system for generating targets.

FIG. 1A illustrates one embodiment of target system 100. Target system 100 includes target assembly 105 coupled to computing device 140. Target assembly 105 includes heating element 110, pad 120, display module 130, and optics module 150. Heating element 110, pad 120, and display module 130 may be coupled to each other utilizing adhesives or mechanical mounting. Computing device 140 may be coupled to target assembly 105 in a manner that allows signals to be sent from computing device 140 to display module 130. Target system 100 also includes secondary heating device 160 in the illustrated embodiment. Wired connections, wireless connections, or a combination of the two, may be utilized to couple display module 130 to target assembly 105. As discussed further below with respect to FIG. 1B, display module 130 may be capable of displaying patterns based on signals provided by computing device 140.

Heating element 110, in some embodiments, may apply heat directly to display module 130 thereby producing a detectable infrared pattern. Heating element 110 may be a rubber pad or Kapton heater containing resistive elements. Heating element 110 may also be implemented using heating blankets or ovens. Pad 120, in some embodiments, may be utilized to assist in uniformly distributing heat generated by heating element 110. Pad 120, in some embodiments, may include aluminum or molybdenum. In some embodiments, secondary heating device 160 may be used in conjunction with heating element 110. Secondary heating device 160 may be located outside of target assembly 105 and may direct heat such that it is reflected off of target assembly 105 into the path of a thermal imaging device, such as a Forward Looking Infrared (FLIR) device, or other detector viewing target assembly 105. Infrared patterns based on what is present on display module 130 may be generated or enhanced through the use of secondary heating device 160. In some embodiments, secondary heating device 160 may be used without heating element 110 to form an infrared pattern that is based on what is displayed on display module 130. In some embodiments, heating element 110 and/or secondary heating device 160 may provide an amount of heat that is variable and user-selectable.

Computing device 140 may, in various embodiments, comprise equipment capable of generating electrical signals that may be sent to target assembly 105. Computing device 140 may also include equipment (such as memory elements) to store target patterns or sequences. In some embodiments, computing device 140 may include facilities for developing target patterns or sequences of target patterns. The target patterns or sequences may be sent to target assembly 105 using electrical signals. Various embodiments of components suitable to implement computing device 140 are discussed below with respect to FIG. 2.

In some embodiments, optics module 150 may project the focal plane of display module 130. This may avoid problems associated with parallax when equipment is viewing target patterns on display module 130. This may also help equipment viewing display module 130 focus on display module 130 by, for example, making display module 130 appear to be further away from equipment than display module 130 actually is. Display module 130 may be at the focal plane of optics module 150. Optics module 150 may include collimating optics such as one or more lenses, one or more mirrors, and/or a combination of lenses and mirrors. Suitable components of optics module 150 in various embodiments include a spherical mirror, a telescopic mirror, a convex lens, a planar-convex lens, a multi-lens system, and/or a multi-mirror system. Utilizing optics module 150 may place the target assembly at the focal plane of optics module 150. Optics module 150 may be configured to project the focal plane to infinity such that light rays that exit optics module 150 may appear as parallel to observers of target assembly 105. In various embodiments, optics module 150 may be adjustable such that the focal length may be varied.

In operation, in various embodiments, system 100 may provide targets for various equipment, such as weapons or detection equipment. Patterns displayed on display module 130 may serve as targets to this equipment. Display module 130 may include pixel elements 136 (of FIG. 1B as described further below) arranged in a grid or other suitable configurations. The configuration of pixel elements 136 may be processed by computing device 140 such that computing device 140 may send signals to form patterns on the configuration of pixel elements 136. Optics module 150 may facilitate the use of the patterns present on display module 130 by adjusting the focal plane of the displayed pattern. In some embodiments, the patterns present on display module 130 may provide infrared targets when target assembly 105 includes heating element 110 (and, in some embodiments, pad 120). In some embodiments, target assembly 105 may not include heating element 110, heating device 160 and/or pad 120 (i.e., such as when only visible targets are needed). In certain situations, such as when only providing IR targets, target assembly 105 may not include optics module 150. In some embodiments, using target assembly 105 may be more cost-effective.

In some embodiments, target system 100 may be programmable. For example, computing device 140 may include one or more memory elements (such as one or more computer-readable storage mediums) that store patterns and may be instructed to retrieve one or more of the stored patterns and cause display module 130 to display the patterns by generating signals corresponding to the retrieved patterns and sending them to target assembly 105. The stored patterns may represent targets in various spectrums, such as the visible and various IR spectrums (Near IR (NIR), Mid-wave IR (MWIR), Far IR (FIR), and/or other suitable IR spectrums). Computing device 140, or other suitable devices, may be used to design target patterns that may be presented using target assembly 105.

In some embodiments, target system 100 may provide dynamic targets. In some situations, computing device 140 may remain coupled to target assembly 105 such that patterns displayed on target assembly 105 may be changed according to stored programs or at the command of a user of computing device 140. Computing device 140 may communicate signals corresponding to such dynamic target patterns using wired and/or wireless mediums. For example, computing device 140 may send signals that cause a shape to change its location on display module 130 over time. In various embodiments, computing device 140 may send signals that cause patterns displayed on target assembly 105 to change over time, such as by causing their size to change, their shape to change, and/or their location to change.

In various embodiments, target system 100 may provide various target patterns to calibrate or align aspects of equipment (i.e., weapons, guidance systems, and/or cameras). Patterns may be displayed in various spectrums, such as the visible and various infrared spectrums. Computing device 140 may be configured to manually or automatically display various patterns in order to facilitate calibration. Computing device 140 may store patterns that aid in calibrating various pieces of equipment. These patterns may be automatically displayed when input to computing device 140 indicates the type of equipment that is to be calibrated. In one example, to assist alignment, a cross hair pattern may be displayed on target assembly 105. In another example, resolution may be calibrated by displaying patterns such as a three-bar pattern (i.e., in the visible spectrum) or a four-bar pattern (i.e., in the IR spectrum) of a spatial frequency or a chirp pattern representing various spatial frequencies at once. In some embodiments, the contrast may be calibrated. A pattern may be displayed on target assembly 105 and the focal length of optics module 150 may be varied such that the contrast of the displayed pattern changes. For example, the focal length of optics module 150 may be varied to be greater than the focal length of the equipment being tested. In various embodiments, equipment may be tested for distortion by displaying a regular pattern on target assembly 105 to detect the presence of distortion. The regular pattern may include a grid of regularly-spaced lines or dots.

Figure 1B:
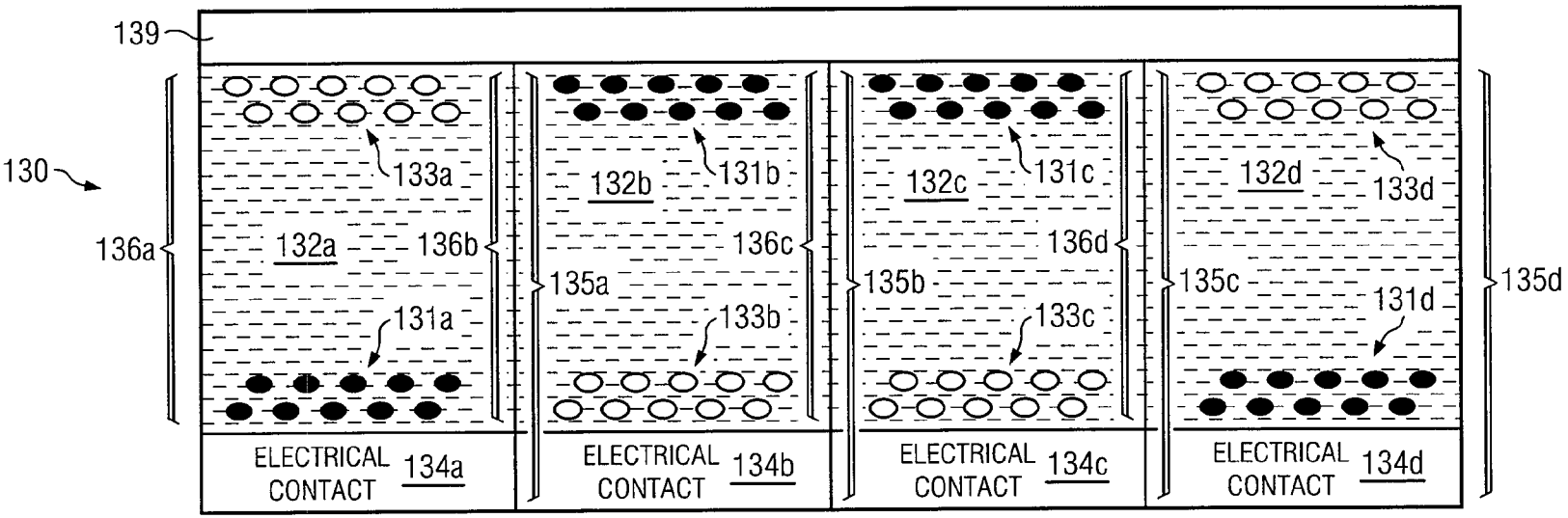
FIG. 1B illustrates one embodiment of a portion of the display module of FIG. 1A.

FIG. 1B illustrates one embodiment of a portion of display module 130 of FIG. 1A. FIG. 1B illustrates how patterns may be displayed on display module 130 in various spectrums, such as the visible and IR spectrums. Display module 130 includes pixel elements 135*a-d* coupled to window 139. Pixel elements 135*a-d* each include display segments 136*a-d* and electrical contacts 134*a-d*, respectively. Display segments 136*a-d* include first pigments 131*a-d*, fluids 132*a-d*, and second pigments 133*a-d*, respectively. Electrical contacts 134*a-d* may be configured to change the electrical fields in fluids 132*a-d*, respectively, using electrical signals received from computing device 140 of FIG. 1A.

Each pixel element 135, in some embodiments, may use similar materials as found in VIZPLEX imaging film produced by the E-INK CORPORATION. Pigments 131 and 133 may comprise common paints, welsbach materials, lampblack, aluminum, silver, and/or gold particles or any other particles that may be charged. In an example operation, first pigments 131 and second pigments 133 may be oppositely charged as they are suspended in fluids 132. As a result, in some embodiments, first pigments 131 and second pigments 133 may be located at different ends of display segments 136. Pigments 131 and 133 may also be configured such that they have different emissivity characteristics. For example, pigments 131 may have high emissivity while pigments 133 may have low emissivity. In some embodiments, the emissivity characteristics of pigments 131 and 133 may be appreciable in the 8-14 micron and/or the 3-5 micron bandwidths. A variety of solutions or liquids may be used alone or in combination to form fluids 132. Such solutions and/or liquids should allow for the movement of pigments 131 and 133 in response to the presence of varying electrical fields in fluids 132. Fluids 132 may include a solvent or alcohol.

In some embodiments, electrical contacts 134 may include one or more of: metal leads, pins, ports, serial connectors, parallel connectors, cable interfaces, and/or plugs. Electrical contacts 134 may receive electrical signals in a manner that causes a corresponding electric field to form in display segments 136. In some embodiments, electrical contacts 134 may include suitable components to be coupled to computing device 140 of FIG. 1A. For example, such components may include one or more of: cables, network interfaces, Bluetooth interfaces, interfaces that operate using any of the Institute of Electrical and Electronics Engineers (IEEE) 802 specifications, infrared interfaces, radio frequency (RF) interfaces, and wired interfaces. Electrical contacts 134 may also include converters such as digital-to-analog and analog-to-digital converters. For example, such converters may receive a digital signal and produce an analog signal that causes a particular electrical field to be present in display segments 136. In various embodiments, electrical contacts 134 may also include converters that can form DC signals from AC signals and vice versa.

In some embodiments, window 139, may aid thermal transmission and detection of the emissivity of display segments 136. Window 139 may be formed using one or more of zinc sulfide, zinc selenide, and/or germanium. In some embodiments, utilizing window 139 may provide for infrared patterns to be formed in the 3-5 microns and 8-14 microns spectrums.

As discussed above, in various embodiments, various signals may be present at electrical contacts 134*a-d* causing various electrical fields in display segments 136*a-d*, respectively. Since pigments 131 and 133 are oppositely charged, the electrical fields present in display segments 136*a-d* may cause pigments 131 and 133 to be displaced. For example, in the depicted embodiment, display segment 136*a* may have an electric field that is different than display segment 136*b* because the electrical signals present at electrical contacts 134*a-b* are different. As a result, the location of pigments 131*a-b* are different within display segments 136*a-b*, respectively. For similar reasons, the location of pigments 133*a-b* are different within display segments 136*a-b*, respectively.

In some embodiments, the electrical signals present at electrical contacts 134*a* and 134*d* may be the same. As a result, in the depicted embodiment, second pigments 133*a* and 133*d* may be located in the same portion of display segments 136*a* and 136*d*, respectively. Similarly, in the depicted embodiment, first pigments 131*a* and 133*d* may be located in the same portion of display segments 136*a* and 136*d*, respectively. In yet another example embodiment, the electrical signals present at electrical contacts 134*b-c* may also be the same, causing substantially similar electrical fields to be present in display segments 136*b-c*. As in the depicted embodiment, this may cause first pigments 131*b-c* to be located in similar portions of display segments 136*b-c*, respectively, as well as cause second pigments 133*b-c* to be located in similar portions of display segments 136*b-c*, respectively.

In some embodiments, when display module 130 is viewed, the line of sight passes through window 139 onto display segments 136*a-d*. Thus, the pigments (either first pigments 131*a-d* or second pigments 133*a-d*) present on the portion of display segments 136*a-d* adjacent to window 139 may be viewed. This viewing may occur in the visible spectrum, the infrared spectrum, and/or other spectrums. For example, first pigments 131*a-d* and second pigments 133*a-d* may have different thermal emissivity characteristics such that a device may be able to detect which pigment is present at the portion of display segments 136*a-d* adjacent to window 139. In various embodiments, this may allow display module 130 to display patterns (e.g., in the visible or infrared spectrums).

Figure 2:
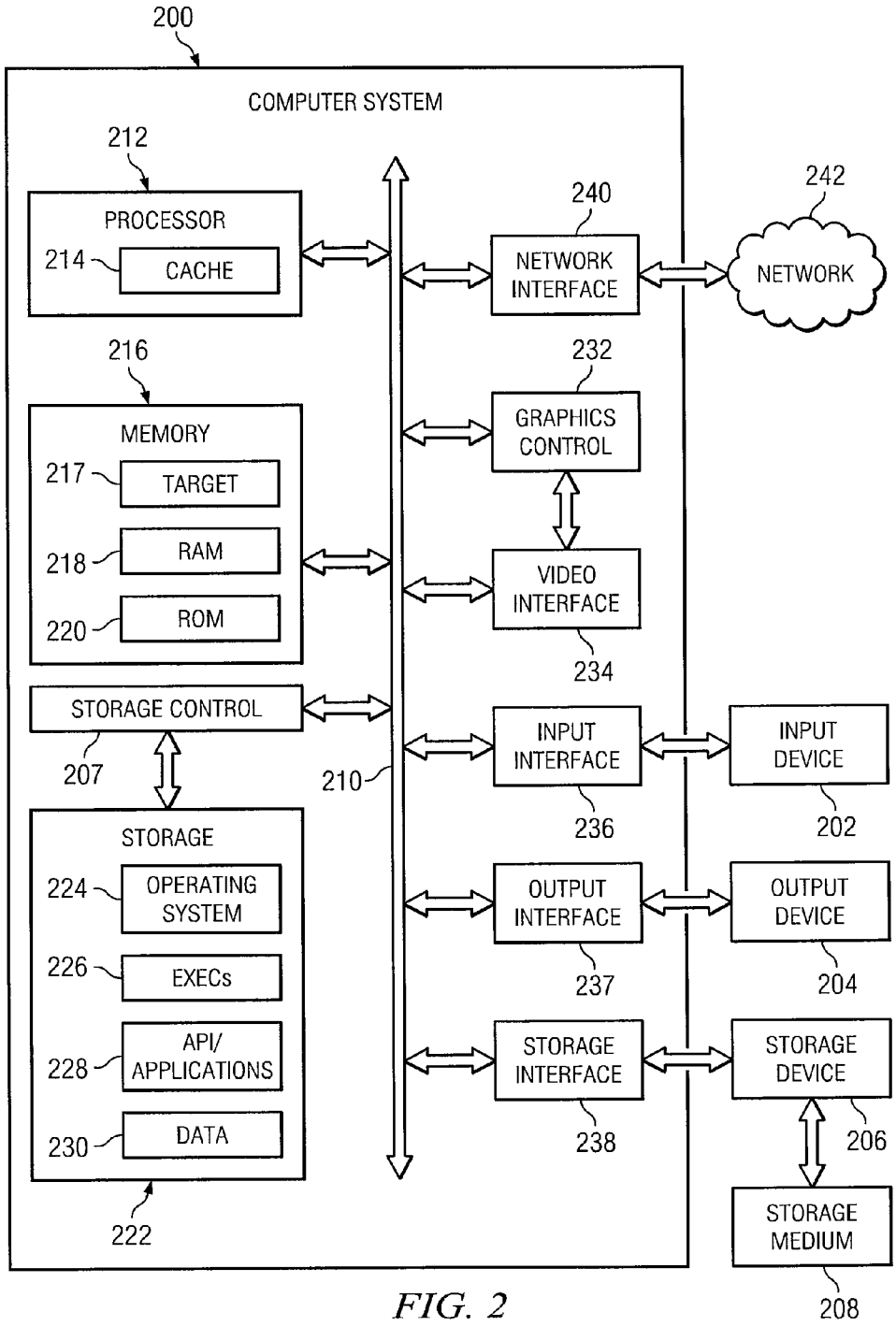
FIG. 2 illustrates one embodiment of a computer system that may be used in the system of FIG. 1A.

FIG. 2 illustrates an example computer system 200 suitable for implementing one or more portions of particular embodiments of a target system. For example, aspects of computer system 200 may be utilized to determine patterns for display, generate electrical signals representing target patterns, and/or storing and retrieving target patterns. Although the present disclosure describes and illustrates a particular computer system 200 having particular components in a particular configuration, the present disclosure contemplates any suitable computer system having any suitable components in any suitable configuration. Moreover, computer system 200 may take any suitable physical form, such as for example one or more integrated circuit (ICs), one or more printed circuit boards (PCBs), one or more handheld or other devices (such as mobile telephones or PDAs), one or more personal computers, or one or more super computers. Computing device 140 and other components discussed above with respect to FIGS. 1A and 1B, the steps discussed in FIG. 3, and computing device 450 may be implemented using all of the components, or any appropriate combination of the components, of computer system 200 described below.

Computer system 200 may have one or more input devices 202 (which may include a keypad, keyboard, mouse, stylus, etc.), one or more output devices 204 (which may include one or more displays, one or more speakers, one or more printers, etc.), one or more storage devices 206, and one or more storage medium 208. An input device 202 may be external or internal to computer system 200. An output device 204 may be external or internal to computer system 200. A storage device 206 may be external or internal to computer system 200. A storage medium 208 may be external or internal to computer system 200.

System bus 210 couples subsystems of computer system 200 to each other. Herein, reference to a bus encompasses one or more digital signal lines serving a common function. The present disclosure contemplates any suitable system bus 210 including any suitable bus structures (such as one or more memory buses, one or more peripheral buses, one or more a local buses, or a combination of the foregoing) having any suitable bus architectures. Example bus architectures include, but are not limited to, Industry Standard Architecture (ISA)

bus, Enhanced ISA (EISA) bus, Micro Channel Architecture (MCA) bus, Video Electronics Standards Association local (VLB) bus, Peripheral Component Interconnect (PCI) bus, PCI-Express bus (PCI-X), and Accelerated Graphics Port (AGP) bus.

Computer system 200 includes one or more processors 212 (or central processing units (CPUs)). A processor 212 may contain a cache 214 for temporary local storage of instructions, data, or computer addresses. Processors 212 are coupled to one or more storage devices, including memory 216. Memory 216 may include random access memory (RAM) 218 and read-only memory (ROM) 220. Data and instructions may transfer bidirectionally between processors 212 and RAM 218. Data and instructions may transfer unidirectionally to processors 212 from ROM 220. RAM 218 and ROM 220 may include any suitable computer-readable storage media. Computer system 200 includes fixed storage 222 coupled bi-directionally to processors 212. Fixed storage 222 may be coupled to processors 212 via storage control unit 207. Fixed storage 222 may provide additional data storage capacity and may include any suitable computer-readable storage media. Fixed storage 222 may store an operating system (OS) 224, one or more executables (EXECS) 226, one or more applications or programs 228, data 230 and the like. Fixed storage 222 is typically a secondary storage medium (such as a hard disk) that is slower than primary storage. In appropriate cases, the information stored by fixed storage 222 may be incorporated as virtual memory into memory 216.

Processors 212 may be coupled to a variety of interfaces, such as, for example, graphics control 232, video interface 234, input interface 236, output interface 237, and storage interface 238, which in turn may be respectively coupled to appropriate devices. Example input or output devices include, but are not limited to, video displays, track balls, mice, keyboards, microphones, touch-sensitive displays, transducer card readers, magnetic or paper tape readers, tablets, styli, voice or handwriting recognizers, biometrics readers, or computer systems.

Network interface 240 may couple processors 212 to another computer system or to network 242. Network interface 240 may include wired, wireless, or any combination of wired and wireless components. Such components may include wired network cards, wireless network cards, radios, antennas, cables, or any other appropriate components. With network interface 240, processors 212 may receive or send information from or to network 242 in the course of performing steps of particular embodiments. Particular embodiments may execute solely on processors 212. Particular embodiments may execute on processors 212 and on one or more remote processors operating together.

In a network environment, where computer system 200 is connected to network 242, computer system 200 may communicate with other devices connected to network 242. Computer system 200 may communicate with network 242 via network interface 240. For example, computer system 200 may receive information (such as a request or a response from another device) from network 242 in the form of one or more incoming packets at network interface 240 and memory 216 may store the incoming packets for subsequent processing. Computer system 200 may send information (such as a request or a response to another device) to network 242 in the form of one or more outgoing packets from network interface 240, which memory 216 may store prior to being sent. Processors 212 may access an incoming or outgoing packet in memory 216 to process it, according to particular needs. In various embodiments, such activity may be used to implement aspects of computing device 140 and electrical contacts 134*a-d* of FIGS. 1A and 1B.

Particular embodiments involve one or more computer-storage products that include one or more tangible, computer-readable storage media that embody software for performing one or more steps of one or more processes described or illustrated herein. In particular embodiments, one or more portions of the media, the software, or both may be designed and manufactured specifically to perform one or more steps of one or more processes described or illustrated herein. In addition or as an alternative, in particular embodiments, one or more portions of the media, the software, or both may be generally available without design or manufacture specific to processes described or illustrated herein. Example computer-readable storage media include, but are not limited to, CDs (such as CD-ROMs), FPGAs, floppy disks, optical disks, hard disks, holographic storage devices, ICs (such as ASICs), magnetic tape, caches, PLDs, RAM devices, ROM devices, semiconductor memory devices, and other suitable computer-readable storage media. In particular embodiments, software may be machine code which a compiler may generate or one or more files containing higher-level code which a computer may execute using an interpreter.

As an example and not by way of limitation, memory 216 may include one or more computer-readable storage media embodying software (e.g., code) and computer system 200 may provide particular functionality described or illustrated herein as a result of processors 212 executing the software (e.g., code). Such a configuration may, in various embodiments, be suitable for implementing aspects of computing device 140 of FIG. 1A. Memory 216 may store (e.g., in RAM 218 and/or ROM 220) and processors 212 may execute the software. Memory 216 may read the software from the computer-readable storage media in mass storage device 216 embodying the software or from one or more other sources via network interface 240. When executing the software (such as target program 217), processors 212 may perform one or more steps of one or more processes described or illustrated herein (for example, operations of computing device 140 of FIG. 1A, steps described in FIG. 3, or computing device 450 of FIG. 4), which may include defining one or more data structures for storage in memory 216 and modifying one or more of the data structures as directed by one or more portions the software, according to particular needs. For example, patterns representing targets may be stored, retrieved, and designed utilizing processors 212 and memory 216.

In some embodiments, the described processing and memory elements (such as processors 212 and memory 216) may be distributed across multiple devices such that the operations performed utilizing these elements may also be distributed across multiple devices. For example, software operated utilizing these elements may be run across multiple computers that contain these processing and memory elements. Other variations aside from the stated example are contemplated involving the use of distributed computing.

In addition or as an alternative, computer system 200 may provide particular functionality described or illustrated herein as a result of logic hardwired or otherwise embodied in a circuit, which may operate in place of or together with software to perform one or more steps of one or more processes described or illustrated herein. The present disclosure encompasses any suitable combination of hardware and software, according to particular needs.

Although the present disclosure describes or illustrates particular operations as occurring in a particular order, the present disclosure contemplates any suitable operations occurring in any suitable order. Moreover, the present disclosure contemplates any suitable operations being repeated one or more times in any suitable order. Although the present disclosure describes or illustrates particular operations as occurring in sequence, the present disclosure contemplates any suitable operations occurring at substantially the same time, where appropriate. Any suitable operation or sequence of operations described or illustrated herein may be interrupted, suspended, or otherwise controlled by another process, such as an operating system or kernel, where appropriate. The acts can operate in an operating system environment or as stand-alone routines occupying all or a substantial part of the system processing.

Figure 3:
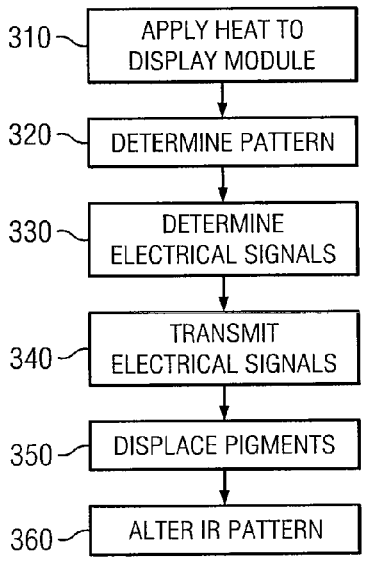
FIG. 3 is a flowchart illustrating one embodiment of the operation of a target system according to the teachings of the present disclosure.

FIG. 3 is a flowchart that illustrates various embodiments of the operation of a target system. In various embodiments, components described above with respect to FIGS. 1A, 1B, and 2 may be used to implement the steps described in FIG. 3. In general, the steps illustrated in FIG. 3 may be combined, modified, or deleted where appropriate, and additional steps may also be added to the example operation. Furthermore, the described steps may be performed in any suitable order.

At step 310, in some embodiments, heat may be applied to a display module. In some embodiments, a heating element (such as heating element 110 of FIG. 1A) may be coupled to the display module and may be configured to generate heat. In various embodiments, a heating device not coupled to the display module (such as secondary heating device 160 of FIG. 1A) may apply heat to the display module. Applying the heat to the display module may provide a pattern in the IR spectrum.

At step 320, in some embodiments, a pattern may be determined. The pattern may be retrieved from the memory of a computing device (such as computing device 140). The determined pattern may be designed by a user of the computing device. The pattern may be determined based on a calibration activity. In one example, to assist alignment, a cross hair pattern may be determined. In another example, when testing resolution, patterns such as a three-bar or four-bar pattern. In some embodiments, a pattern may be determined by analyzing images or video of surroundings (such as described further below with respect to FIG. 4).

At step 330, in some embodiments, electrical signals may be determined corresponding to the determined pattern. The computing device may determine the electrical signals based on the configuration of the display module. For example, pixel elements of the display module may be configured in a grid. The computing device may determine a mapping between the pattern determined at step 320 and a configuration of pixel elements of the display module.

At step 340, in some embodiments, the electrical signals determined at step 330 may be transmitted to the display module. This may occur using wired or wireless mediums. The display module may include electrical contacts at the pixel elements where the transmitted electrical signals may be applied. At step 350, in various embodiments, pigments within the pixel elements of the display module may be displaced as a result of the transmitted electrical signals. For example, each pixel element may include two pigments, oppositely charged, that are suspended in a solution. The display module may be coupled to the electrical contacts such that the electrical field present in the solution may be affected by the electrical signals sent at step 340. As a result of the change in the electrical field, the orientation of the two types of pigments in pixel elements where the electrical field was changed may be changed such that the pigments are displaced.

At step 360, in some embodiments, the IR pattern generated at step 310 may be altered. This may occur in response to the pigments within the pixel elements having been displaced. For example, the pigments in a pixel element may have different emissivity characteristics. When the pigments are displaced in step 350, the different emissivity characteristics of the displaced pigments may alter the IR pattern generated at step 310 since the pigments have been displaced. In various embodiments, IR target patterns may be generated by displacing the pigments in accordance with the electrical signals generated by the computing device. The altered IR pattern may match or resemble the pattern determined at step 320.

In various embodiments, steps 310-360 may be repeated if it is determined that the target pattern should be modified. The target pattern may be modified because the target pattern is dynamic, in various embodiments. The target pattern may be modified because a sequence of target patterns may need to be displayed. The target patterns may be modified based on the passage of time or based on activity by a user.

Figure 4:
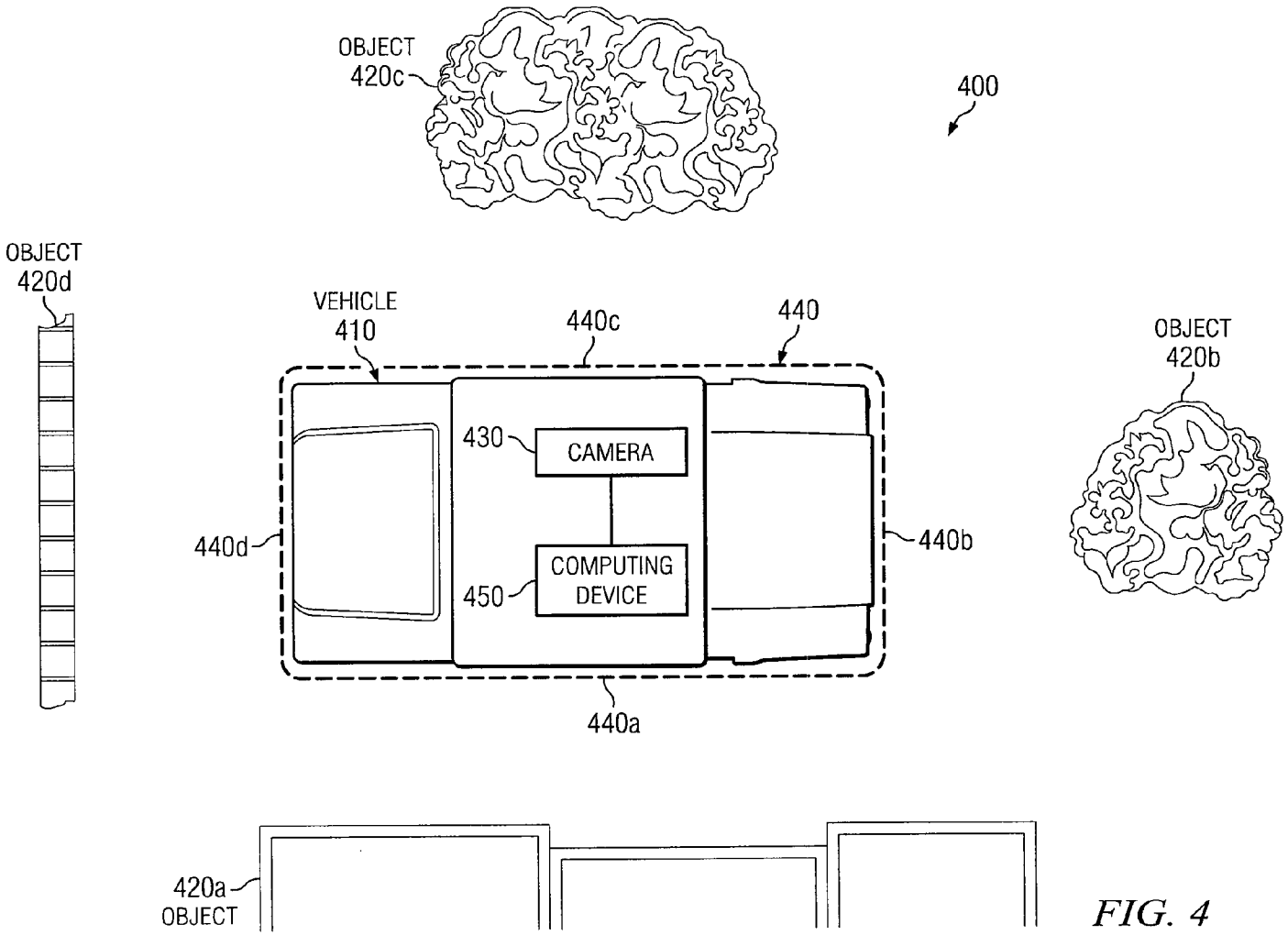
FIG. 4 illustrates one embodiment of a camouflage system that may utilize elements of a target system according to teachings of the present disclosure.

FIG. 4 illustrates one embodiment of a camouflage system 400. System 400 may provide an example of how the components and steps described above with respect to FIGS. 1A-3 may be utilized in a camouflage system. System 400 includes vehicle 410 covered by cloak 440. Vehicle 410 may include computing device 450 that is coupled to camera 430 and cloak 440. Vehicle 410 may be in an environment that includes objects 420*a-d*. In some embodiments, cloak 440 may generate patterns that resemble one or more of objects 420*a-d*. This may be done by computing device 450 receiving signals from camera 430 and generating patterns for cloak 440 that are similar to the signals received from camera 430.

In some embodiments, vehicle 410 may be an aircraft, a boat, a land vehicle (and/such as a car, truck, and/or tank) or other forms of vehicles. Vehicle 410 may, in some embodiments, represent stationary objects such as buildings, equipment, or people.

In some embodiments, objects 420*a-d* may include plants, animals, rocks, buildings, natural and/or artificial structures. Objects 420*a-d* may include objects whose infrared pattern is static or dynamic. Objects 420*a-d* may be stationary or mobile, in various embodiments.

In some embodiments, camera 430 may be operable to capture images or video in the visible or various IR spectrums (such as FUR cameras that may be used to implement camera 430). Camera 430 may be coupled to computing device 450 utilizing wired and/or wireless connections such that images or video captured by camera 430 may be transmitted to computing device 450.

In some embodiments, cloak 440 may include an array of pixel elements that are operable to display patterns in response to signals received from computing device 450. Such patterns may be in the visible and/or infrared spectrum. In some embodiments, cloak 440 may be rigid or flexible. In one example, cloak 440 may include structures similar to target assembly 105 as described above with respect to FIGS. 1A and 1B.

Computing device 450 may be coupled to cloak 440 such that signals representative of patterns may be transmitted to cloak 440. Computing device 450 may include memory and processing elements that allow computing device 450 to store patterns, retrieve patterns, form patterns, and compare patterns. The memory and processing elements may also be used to analyze signals received from camera 430. Computing device 450 may include structures similar to computing device 140 of FIG. 1A and computer system 200 of FIG. 2.

In operation, in various embodiments, camera 430 may capture images and/or video (i.e., in the visible and/or IR spectrums) of the environment around vehicle 410, including objects 420*a-d*. This information may be transmitted to computing device 450. Computing device 450 may generate patterns that are similar to the captured images and/or video, and determine patterns that should be displayed by cloak 440 and transmits them to cloak 440. In some embodiments, computing device 450 selects patterns that are similar to objects 420*a-d*. The pattern transmitted to cloak 440 may be determined by compiling several patterns similar to objects 420*a-d*. For example, computing device 450 may generate a pattern for portion 440*c* of cloak 440 in response to the information captured by camera 430 regarding object 420*a*. In another exemplary operation, computing device 450 may generate a pattern for portion 440*a* of cloak 440 in response to the information captured by camera 430 regarding object 420*c*. In various embodiments, causing the portion of cloak 440 to resemble one or more objects 420 that are behind that portion of cloak 440 may cause vehicle 410 to be camouflaged. Computing device 450 may also be configured to update all of cloak 440 or one or more of portions 440*a-d* in response to changes in any of objects 420*a-d* as detected by camera 430. In such a manner, in various embodiments, vehicle 410 may be provided with camouflage capabilities.

In some embodiments, computing device 450 may store a pre-defined set of patterns and may use the information about objects 420*a-d* captured by camera 430 to determine which of the pre-defined set of patterns should be displayed on cloak 440.

Computing device 450 may determine that the pre-defined pattern that matches closest to the information captured by camera 430 should be displayed by cloak 440. In some embodiments, computing device 420 may store a pre-defined set of patterns and a user may select one or more patterns to be displayed on cloak 440 without use of camera 430. In such and other embodiments, camera 430 may not be present in system 400.

Although several embodiments have been illustrated and described in detail, it will be recognized that modifications and substitutions are possible without departing from the spirit and scope of the appended claims.

What is claimed is:

1. A system, comprising:

a display module comprising a plurality of pixel elements operable to display target patterns, wherein each pixel element comprises:

a display segment;

a plurality of first charged pigments housed within the display segment each having a first charge;

a plurality of second charged pigments housed within the display segment each having a second charge, wherein the first charge is opposite the second charge;

an electrical contact coupled to the display segment and operable to receive signals that cause an electric field to be present in the display segment;

a processor that executes code to transmit signals to the display module that cause an electric field to be present in at least one pixel element of the plurality of pixel elements;

an optics module coupled to the display module and operable to project a focal plane associated with the display module; and a heating element coupled to the display module and operable to emit an infrared pattern that is modified by the plurality of pixel elements.

2. The system of claim 1, wherein the code comprises stored target patterns.

3. The system of claim 1, wherein the code when executed by the processor further transmits a set of signals corresponding to a dynamic target pattern.

4. The system of claim 1, wherein the optics module comprises a mirror.

5. The system of claim 1, wherein the optics module comprises a lens.

6. The system of claim 1, further comprising:

a window coupled to the display module and operable to facilitate thermal transmission.

7. The system of claim 1, wherein the plurality of first charged pigments has a different emissivity than the plurality of second charged pigments.

8. A system, comprising:

a display module comprising a plurality of pixel elements operable to display patterns, wherein each pixel element comprises:

a display segment;

a plurality of first charged pigments housed within the display segment each having a first charge;

a plurality of second charged pigments housed within the display segment each having a second charge, wherein the first charge is opposite the second charge;

an electrical contact coupled to the display segment and operable to receive signals which cause an electric field to be present in the display segment;

a processor that executes code to transmit signals to the display module that cause an electric field to be present in at least one pixel element of the plurality of pixel elements; and a heating element coupled to the display module and operable to emit an infrared pattern that is modified by the plurality of pixel elements.

9. The system of claim 8, wherein the code comprises stored target patterns.

10. The system of claim 8, wherein the code when executed by the processor further transmits a set of signals corresponding to a dynamic target pattern.

11. The system of claim 8, further comprising a window coupled to the display module and operable to facilitate thermal transmission.

12. The system of claim 8, further comprising at least one lens coupled to the display module and operable to project a focal plane associated with the display module.

13. The system of claim 8, further comprising at least one mirror coupled to the display module and operable to project a focal plane associated with the display module.

14. The system of claim 8, further comprising a second heating element operable to direct thermal energy towards an environment surrounding the plurality of pixel elements.

15. The system of claim 8, wherein the plurality of first charged pigments has a different emissivity than the plurality of second charged pigments.

16. The system of claim 8, further comprising:

a camera operable to capture an image of at least one object that is in the surroundings of the display module; and wherein the code, when executed by the one processor, analyzes the captured image and transmits a set of signals to the display module in response to analyzing the captured image thereby causing the display module to display a camouflage pattern.

17. The system of claim 8, wherein the plurality of pixel elements are further operable to display camouflage patterns.

18. A method for generating a target, comprising:

applying heat to a display module to form an infrared pattern associated with the display module, wherein the display module comprises a plurality of display segments that each comprise a plurality of first charged pigments having a first charge and a plurality of second charged pigments having a second charge that is opposite the first charge;

determining a target pattern;

generating a plurality of electrical signals representative of the target pattern;

applying the plurality of electrical signals to the display module;

displacing, within at least one display segment of the plurality of display segments, the plurality of first charged pigments with respect to the plurality of second charged pigments in response to applying the plurality of electrical signals to the display module; and altering the infrared pattern in response to displacing the plurality of first charged pigments with respect to the plurality of second charged pigments.

19. The method of claim 18, wherein determining the target pattern comprises retrieving a stored target pattern.

20. The method of claim 18, wherein generating the plurality of electrical signals representative of the target pattern comprises generating electrical signals representative of a dynamic target pattern.

21. The method of claim 18, further comprising directing thermal energy towards an environment surrounding the plurality of pixel elements.

* * * * *